United States Patent [19]

Ono et al.

[11] Patent Number: 4,730,353

[45] Date of Patent: Mar. 8, 1988

[54] X-RAY TUBE APPARATUS

[75] Inventors: Katsuhiro Ono, Kawasaki; Tatsuya Sakuma, Yokohama; Hiroshi Takahashi, Tokyo, all of Japan

[73] Assignee: Kabushiki Kaisha Toshiba, Kawasaki, Japan

[21] Appl. No.: 31,207

[22] Filed: Mar. 30, 1987

Related U.S. Application Data

[63] Continuation of Ser. No. 739,098, May 30, 1985, abandoned.

[30] Foreign Application Priority Data

May 31, 1984 [JP] Japan ..... 59-111905

[51] Int. Cl.[4] ..... H01J 35/00

[52] U.S. Cl. ..... 378/138; 378/136; 378/113

[58] Field of Search ..... 378/113, 136, 138; 313/341, 453

[56] References Cited

U.S. PATENT DOCUMENTS

| | | | |
|---|---|---|---|
| 2,919,373 | 1/1957 | Riley et al. | 313/341 |
| 3,103,591 | 9/1963 | Rogers et al. | 378/138 |
| 3,743,836 | 7/1973 | Holland et al. | 378/138 |
| 4,065,690 | 12/1977 | Maeyama . | |
| 4,126,805 | 11/1978 | Randall | 378/138 |
| 4,344,011 | 8/1982 | Hayashi et al. | 313/453 |

FOREIGN PATENT DOCUMENTS

| | | |
|---|---|---|
| 2447570 | 4/1975 | Fed. Rep. of Germany . |
| 3136184 | 3/1983 | Fed. Rep. of Germany . |
| 57-34632 | 2/1982 | Japan . |
| 1597693 | 9/1981 | United Kingdom . |

OTHER PUBLICATIONS

Patent Abstracts of Japan unexamined application, E Section, vol. 6, No. 72-May 7, 1982-Kokai-No. 57-13 658.

*Primary Examiner*—Janice A. Howell
*Assistant Examiner*—David P. Porta
*Attorney, Agent, or Firm*—Cushman, Darby & Cushman

[57] ABSTRACT

An X-ray tube apparatus comprises an X-ray tube which includes a vacuum envelope and an anode target and a cathode assembly which are disposed within the vacuum envelope opposing each other. The cathode block has a flat-plate like filament for generating an electron beam, and a beam shaping electrode insulated from this filament. The beam shaping electrode is formed with a beam limiting aperture for passing therethrough of a part of the electron beam emitted from the filament, and a focussing dimple so as to focus the electron beam. When d2 and d3 are assumed to represent the depth of the focussing dimple and the distance between the target surface and the top surface of the focussing dimple opposing this target surface, respectively, the value of the ratio of d3 to d2 satisfies the inequality $1.0 \leqq d3/d2 \leqq 4.0$.

12 Claims, 22 Drawing Figures

X-RAY TUBE APPARATUS

This is a continuation of application Ser. No. 739,098, filed May 30, 1985, which was abandoned upon the filing hereof.

BACKGROUND OF THE INVENTION

The present invention relates to an X-ray tube apparatus and, more particularly, to an X-ray tube apparatus having a rotating anode X-ray tube.

Generally, an X-ray tube apparatus is employed for medical treatment in the form of, for example, an X-ray diagnosis. The X-ray tube apparatus for use in medical treatments, including the examination of the stomach, uses a rotating anode X-ray tube. This rotating anode X-ray tube has a vacuum envelope, in which a cathode assembly and an anode target are received. The anode target has a target disk. The target surface of this target disk and the cathode assembly are disposed in a manner that they are offset from the tube axis of the vacuum envelope and that they oppose each other. The target disk is connected to a rotor, which is driven to rotate by electromagnetic induction produced from a stator provided outside the vacuum envelope.

The anode assembly of the above-mentioned rotating anode X-ray tube has a focussing electrode, which is formed with a focussing dimple. Within this focussing dimple, a tungsten coil filament is provided which is intended to emit electrons. Generally, the electric potential which is applied to the filament is the same as that which is applied to the focussing electrode. Therefore, the electrons emitted from the filament are focussed on the target surface by the electrostatic field in the focussing dimple.

In this cathode assembly, however, a part of the coil filament is allowed to project into the focussing dimple of the focussing electrode. This is because the coil filament must be used within a temperature limited current range and, at the same time, the electric field should be intensified in the neighborhood of the filament. By protruding a part of the filament, the equipotential surface in the vicinity of the filament has a configuration which protrudes toward the target surface at the central portion of the filament. On the other hand, the electrons emitted substantially from side walls of the filament are directed sidewardly of the focussing dimple due to the electric field in the zone between a bottom portion of the focussing dimple and the filament. At the same time, they are directed toward the center of the focussing dimple due to the concaved electric field in the vicinity of the opening end of this dimple, and thus are focussed. Accordingly, the electrons emitted from the side walls of the filament and the electrons emitted from the central portion of the filament can not be focussed in the same spot. In other words, the loci of both electrons emitted from the two opposed side walls of the filament intersect each other on the center axis of the electron beam. When almost all of the electrons have been focussed on the target surface, the electron density distribution as viewed about a portion of the target surface including the center axis of the electron beam is twin-peaked.

In the cathode assembly having the above-mentioned construction, the electrons emitted from the filament can not be focussed, by the focussing electrode, onto a sufficiently small focal area. For this reason, the use of a small filament is required for obtaining a small focal area on the target surface. With such a small filament, however, the electrons are not emitted therefrom with a sufficiently high density unless the temperature of the filament is high. Therefore, the conventional rotating anode X-ray tube has a problem in respect of the limitation of tube current.

Further, it is difficult to direct the electrons towards the anode target, so that it is impossible to obtain a minute focal area. Further, the electron distribution has no sharpness, so that it is impossible to obtain a desired distribution of electrons. For this reason, it is difficult to obtain both a sufficiently high resolution, and a decrease in the maximum value of rise of the temperature on the anode target, due to the incidence of electrons, to thereby cause an increase in the amount of the electrons incident thereupon. Where the projection image is prepared by using the X-rays generated from the anode target, these drawbacks become obstacles to the decrease in photon noises as well as the increase in resolution, failing to obtain a sufficiently clear image.

The use of a flat-plate like cathode filament is contemplated as a method of removing the above-mentioned drawbacks. An example wherein such a filament is used is disclosed in Japanese Patent Disclosure No. 68056/80.

In the X-ray tube proposed in said literature, a cathode filament consisting of a flat strip-like plate is used. The central portion of this cathode filament is flattened by bending both end portions thereof. The cathode filament is formed with leg portions at both its end portions. The leg portions of the cathode filament are mounted on filament supporting struts, respectively. When it is directly heated by passing electric current, the cathode filament emits electrons mainly from its central portion. In this proposal, a focussing electrode whose focussing dimple is small in depth is used. The electrons emitted from the cathode filament are focussed by means of the focussing electrode. The equipotential curve in the vicinity of the focussing electrode has a gentle curve at the central part of the focussing dimple. The anode target is kept high in positive potential relative to the cathode filament and focussing electrode. It is located at a position which is spaced from the focussing electrode by a distance equal to a focal distance of an electron lens thereof.

The above-mentioned conventional example, however, has the following drawbacks. First of all, limitation is imposed upon the focussing of electrons. That is, it is known that the width of spread of the electrons on the anode target, W, is given in the following formula, $$W = 2f \cdot \sqrt{Vo/Va} \ .$$

Where Vo represents the initial velocity energy of electrons, and Va represents the anode potential. Actually, however, when, for example, f=15 mm, Vo=0.2eV, and Va=30 keV are substituted into the above formula, W=0.08 mm. Namely, a sufficiently small focal area is not obtained.

The second drawback is that the loci of the electrons emitted from the side walls of the cathode filament are greatly different from those of the electrons emitted from the central portion thereof. That is to say, a sub-focal area is formed in the distribution of electrons on the anode target. This is because the loci of the electrons emitted from the end portions of the filament are affected by the equipotential curve in the area very near to the surface of the filament. The equipotential curve in such an area, i.e., the gap zone between the end of the filament and the focussing electrode is concaved. Accordingly, in that area, a local concave lens is formed. For this reason, the loci of the electrons emitted from the end portions of the filament come near to the walls of the focussing electrode as compared with a case where the equipotential curve is uniform. The focal length relating to the electrons emitted from the end portions of the filament is smaller than the focal length relating to the electrons emitted from the central portion of the filament. This is because the curvature of the equipotential curve within the focussing electrode becomes greater in those portions of this electrode near to its walls than in the central portion thereof. In the X-ray tube of this proposal, therefore, a sub focal area is formed on the target surface, failing to obtain a sufficiently high degree of focussing. Where the value of electric current is great, the spread of electrons on the anode target has a width due to the space charge which is greater than the width expressed in the above-mentioned formula.

In the case of making the electric potential of the focussing electrode equal to that of the filament and, under this condition, increasing the depth of the focussing electrode to make the focal length small to thereby increase the focussing effect, the electric field becomes weak in the zone near to the filament. Further, in such a case, the space charge limiting diode is formed in said zone. Thus, the value of electric current is varied corresponding to the anode potential. Further, where the anode voltage is around 30 kV, it is sometimes possible that a current value of 10 mA or more is not obtained.

The proposal also discloses the technique of putting a focussing electrode (or another electrode having a shallow focussing dimple at a position slightly forwardly spaced from the focussing electrode), and applying a bias voltage to it, which voltage is higher than a voltage of the filament. This technique, however, has a drawback in that the focusability of the electron beam is decreased in the longitudinal direction of the filament.

Further, in the conventional flat filament, when the temperature of the filament is increased by passing electric current therethrough, the filament is thermally expanded, so that the central portion of the flat filament, i.e., the electron emission surface is greatly curved in such a manner as to protrude toward the target surface. As a consequence, the electron emission surface is greatly displaced relative to the target surface. Thus, the conventional filament is low in reliability and is defective in that the passing of electric current through the filament does not enable a stable tube-current characteristic to be obtained.

SUMMARY OF THE INVENTION

In view of the above, the object of the present invention is to provide an X-ray tube apparatus which makes it possible to obtain a sufficiently small focal area on its anode target and, at the same time, to similarly vary the configuration of, and optionally vary the size of, the focal area by applying bias voltage to the electron beam shaping electrode.

According to the invention, there is provided an X-ray tube apparatus comprising an X-ray tube which includes a vacuum envelope, and an anode target and a cathode assembly which are disposed within the vacuum envelope in a manner to oppose each other.

The cathode assembly has a flat-plate like filament for emitting an electron beam, and a beam shaping electrode insulated from said flat-plate like filament. The beam shaping electrode is formed with a beam limiting aperture for passing therethrough a part of the electron beam emitted from the flat-plate like filament, and a focussing dimple for further passing therethrough the electron beam having passed through the beam limiting aperture so as to focus such electron beam. On the other hand, the anode target has a target surface for being radiated with the electron beam passed through the focussing dimple so as to radiate X-rays. When d2 and d3 are assumed to represent the depth of the focussing dimple, and the distance between the target surface and the opening surface of the focussing dimple opposing this target surface, respectively, the value of the ratio of d3 to d2 satisfies the following equality or inequality.

$$1.0 \leqq d3/d2 \leqq 4.0$$

X-ray tube apparatus further comprises a power source means, which includes a first power source for applying a first voltage across the anode target and the flat-plate like filament, a second power source for applying an electric current to the flat-plate like filament so as to heat the same, and a variable power source for applying a bias voltage to the beam shaping electrode, the bias voltage being positive against the flat-plate like filament.

According to the X-ray tube apparatus of the invention, it is possible with the above-mentioned structure to obtain a sharp minute focal area having less astigmation on the target surface. Particularly, a sub focal area is not produced on the target surface, due to the action of the beam limiting aperture.

Further, according to the X-ray tube apparatus of the invention, the size of the X-ray focal area can optionally be varied by varying the bias voltage while the configuration thereof is being kept substantially fixed. Even when the first voltage of the power source means is increased, the configuration of a focal area on the target surface and the distribution of electron density thereon are kept uniform.

DETAILED DESCRIPTION OF THE PREFERRED EMBODIMENTS

A first embodiment of an X-ray tube apparatus having a rotating anode X-ray tube to which the invention is applied will now be described with reference to FIGS. 1 to 8.

Figure 1:
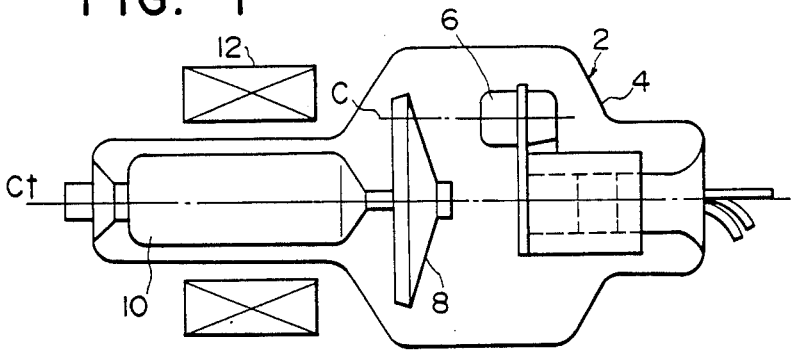
FIG. 1 is a schematic illustration showing the construction of an X-ray tube to which the present invention is applied.

In FIG. 1, a rotating anode X-ray tube 2 is shown. This rotating anode X-ray tube 2 includes a vacuum envelope 4, to one end of which a cathode assembly 6 is vacuum-tightly joined. The cathode assembly 6 is displaced from the tube axis Ct of the envelope 4. A anode target 8 having a target disk is disposed within the envelope 4 opposing the cathode assembly 6. A rotor 10 is connected to the target disk. The portion of this rotor 10 residing on the opposite side to that on which the target disk is provided is joined to the other end of the envelope 4 in a vacuum-tight manner. The rotor 10 is disposed so that it may be driven to rotate due to electromagnetic induction effected by a stator 12 disposed outside the envelope 4.

The rotating anode X-ray tube 2 having the above-mentioned construction is received within a housing (not shown) of the X-ray tube apparatus.

Reference will now be made to a case where the rotating anode X-ray tube 2 having the above-mentioned construction is applied to an X-ray tube used for, for example, photographing of the breast, and allowed to operate under the conditions wherein the anode voltage is 30 kV; the maximum anode current is 20 mA; and the focal area of X-rays is variable in size within a range of 50 $\mu$m to 1 mm. The cathode assembly 6 of the X-ray tube is constructed as shown in FIGS. 2 to 5. In the X-ray tube, the cathode assembly 6 includes a directly heated type cathode filament 20 which is mounted on a pair of filament supporting struts 30. The cathode filament 20 consists of a flat strip-like plate such as, for example, a tungsten or tungsten alloy thin plate whose width Dc is about 2 mm (see FIG. 3) and whose thickness is 0.03 mm or so. The central portion of the cathode filament 20 is flattened so that it constitutes an electron emission surface 22. The filament 20 has a pair of U-shaped portions 24 at both of its sides which are prepared by orthogonally bending both sides and then bending them back so as to form U-like shapes, respectively. The end portions of the filament 20 are bent outwards from the U-shaped portions 24, orthogonally, extending outwards in parallel to the electron emission surface 22, respectively. The end portions are mounted on the pair of filament supporting struts 30 at positions slightly lower than the level of the electron emission surface 22, and are electrically connected thereto.

Figure 2:
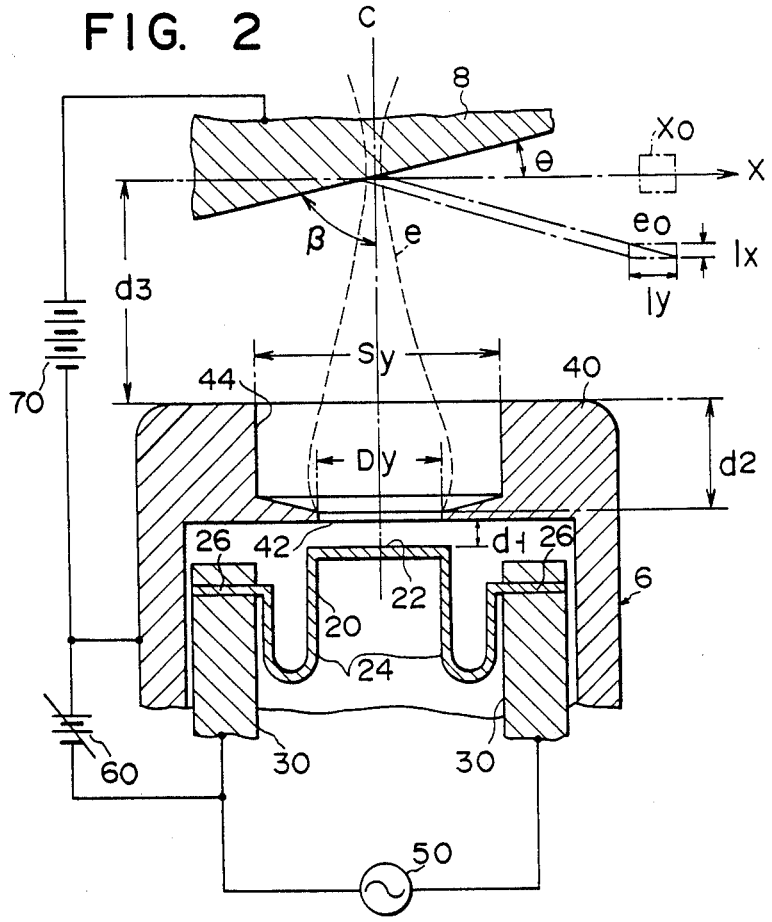
FIG. 2 shows an embodiment of the invention and is a sectional view taken along a radial plane of the X-ray tube including the center axis C of an electron beam in FIG. 1, which shows an anode target and a cathode assembly of the X-ray tube.
Figure 3:
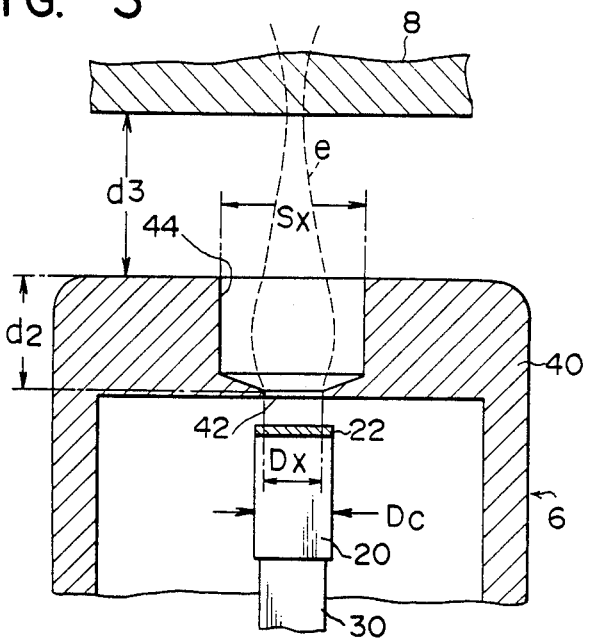
FIG. 3 is a sectional view taken along a plane perpendicular to the plane including both the center axis C of the electron beam in FIG. 1 and the axis Ct of the X-ray tube, which shows the anode target and cathode assembly shown in FIG. 2.

A beam shaping electrode 40 shaped like a circular cup is disposed in such a manner as to enclose the cathode filament 20. The pair of filament supporting struts 30 are fixed to the beam shaping electrode 40 through insulating supporting members (not shown), respectively. The beam shaping electrode 40 is formed with an electron beam limiting aperture 42 in a manner that it opposes the electron emission surface 22 of the filament 20. In this embodiment, the electron beam limiting aperture 42 is rectangular and is smaller in size than the electron emission surface 22. Further, the distance d1 between the electron beam limiting aperture 42 and the electron emission surface 22 is approximately 0.7 mm. The opening surface of the electron beam limiting aperture 42 residing on the side of the electron emission surface 22 is substantially in parallel to this surface 22. A focussing dimple 44 is formed in the electron beam shaping electrode 40 in such a manner that it goes along the beam limiting aperture 42 and that it is continuous thereto. The focussing dimple 44 is rectangular and is larger in size than the electron beam limiting aperture 42. The long side of the rectangular focussing dimple 44 is parallel to the respective long sides of the electron beam limiting aperture 42 and the electron emission surface 22. As shown in FIGS. 2 and 3, the depth d2 of the focussing dimple 44 is sufficiently deep. The bottom portion of the focussing dimple 44 is tapered toward the electron beam limiting aperture 42. The dimension of this tapered bottom portion as taken along the axis C, is very small being one of several parts of the depth d2.

The present inventors have set the positional relationship between the target surface of the anode target $\theta$ and the electron beam limiting aperture 42, taking the apparent focal area into consideration. Reference will now be made thereto. Assume that $\beta$ represents the angle defined between the center axis (which is indicated in FIGS. 2 and 3 by C) of the electron beam e and the target surface of the target 8, and $\theta$ represents the anode angle defined between the direction in which X-rays are drawn out, i.e., X-ray radiation axis X and the target surface. Assume also that lx and ly represent the short side, and the long side, of a rectangular electron-beam section $e_o$, i.e., actual focal area of the electron beam on the target surface, respectively. Consider now a case wherein the rectangular shape of the apparent focal area Xo, as viewed along the X-ray radiation axis X, is so made that the ratio between the long side and the short side may have a value equal to, or smaller than, 1.4 as accepted in the art. If the value of this ratio is 1.0, the apparent focal area is square, which is most preferable. To this end, the configuration of the electron beam impinge surface on the target is set to satisfy the following conditional formula (1).

$$\frac{ly}{lx} = \cot\theta \qquad (1)$$

It should be noted here that since the value of the ratio between the long and short sides of the apparent focal area configuration Xo as viewed along the X-ray radiation axis X may vary up to about 1.4, the ratio of the long side to the short side of the actual focal area $e_o$ of the electron beam may be in the range defined as follows.

$$\frac{1}{\sqrt{2}} \cdot \cot\theta \leqq \frac{ly}{lx} \leqq \sqrt{2} \cdot \cot\theta \qquad (2)$$

When a minimal focal area (for example, a focal area whose one side is 50 $\mu$m) is obtained with the use of a specified tube current, the position on which the dimension of the beam waist, i.e., the dimension of the cross section of the electron beam e is minimum is in coincidence with the target surface. After the electron beam e has passed through the beam waist section, it gradually spreads due to mutual repulsion between electrons, whereby the dimension of its section gradually increases. Note that the long side of the rectangular shape of the actual focal area $e_o$ of the electron beam is parallel to the X-ray radiation axis X.

In order to make uniform the current density distribution at the actual focal area $e_o$ of the electron beam on the target, the configuration of the beam limiting aperture 42 of the beam shaping electron 40 is made substantially similar to that of the actual focal area $e_o$ of the electron beam. In this rotating anode X-ray tube 2, it is necessary that the long side and short side of the electron beam e having passed through the rectangular electron beam limiting aperture 42 are reduced to coincide, on the target surface, i.e., at the beam waist position, with the long side and short side of the actual focal area $e_o$. For satisfying this requirement, the dimensions of the respective portions of the rotating anode X-ray tube 2 are set as follows.

As shown in FIGS. 2 and 3, the depth d2 of the focussing dimple 44 is made equal as viewed in the widthwise direction as well as in the lengthwise direction. That is, the focussing dimple 44 is constructed such that the value of the ratio, to the depth d2, of the distance d3 between the position of the focal point on the target 8 and the opposing surface of the beam shaping electrode 40 opposing the target surface is in the range of 0.25 to 1.0. That is, the relationship between said d2 and d3 satisfies the following condition.

$$1.0 \leqq \frac{d3}{d2} \leqq 4.0 \qquad (3)$$

Figure 4:
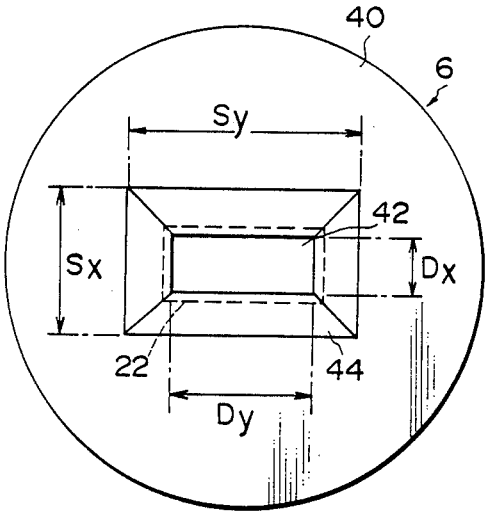
FIG. 4 is a plan view showing the beam shaping electrode shown in FIGS. 2 and 3, in which, for comparison, the electron emitting portion of the filament is indicated by a broken line.
Figure 5:
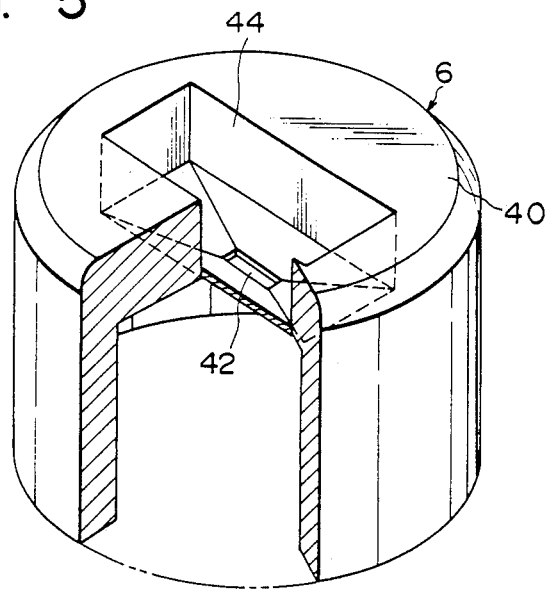
FIG. 5 is a perspective view, partly broken, of the beam shaping electrode of FIG. 4.

Further, the dimensional relationship between the rectangular sections of the beam limiting aperture 42 and the focussing dimple 44 are determined as follows. When, as shown in FIG. 4, Dy and Dx are assumed to represent the long side, and the short side, of the beam limiting aperture 42, respectively; Sy and Sx to represent the long side, and the short side, of the rectangular focussing dimple 44, respectively; and P and Q represent the value of the ratio Sy/Dy between the long side of the beam limiting aperture 42 and the long side of the focussing dimple 44, and the value of the ratio Sx/Dx between the short side of the beam limiting aperture 42 and the short side of the focussing dimple 44, respectively, the value of the ratio of said P to said Q is set to the following range.

$$0.4 < \frac{P}{Q} < 2.0 \qquad (4)$$

It is to be noted here that the depth of the beam limiting aperture 42 is made as small as 1/10 or less of the depth d2 of the focussing dimple 44, or more preferably, 1/20 or so.

The preferable dimensions of the respective portions of the rotating anode X-ray tube 2 under the above-mentioned operational conditions are shown below, by way of example.

Dx=1.2 mm, Dy=3.0 mm,
Sx=5.2 mm, Sy=6.0 mm,
d2=4.1 mm, d3=8.0 mm

The depth of the beam limiting aperture 42, 0.2 mm
$\beta$=70°, and $\theta$=20°

Reference will now be made to the voltages applied to the anode target 8, beam shaping electrode 40, and filament 20 dimensionally set as mentioned above.

The filament 20 is applied, via the filament supporting strut 30, with a heating power from a filament power source 50, whereby the filament 20 is directly heated. Further, a bias voltage is applied to the beam shaping electrode 40 from a bias power source 60 whose positive bias voltage is variable within the range of 50 to 1000 V. That is to say, the bias voltage is higher than the voltage of the filament 20. Further, a positive anode voltage of about 30 kV is applied to the anode target 8 from a power source 70. When the bias voltage applied is around 200 V, the beam waist of the electron beam e is located at the target surface.

Next, the operation of the rotating anode X-ray tube 2 of the X-ray tube apparatus of the invention will now be described with reference to FIG. 6.

Figure 6:
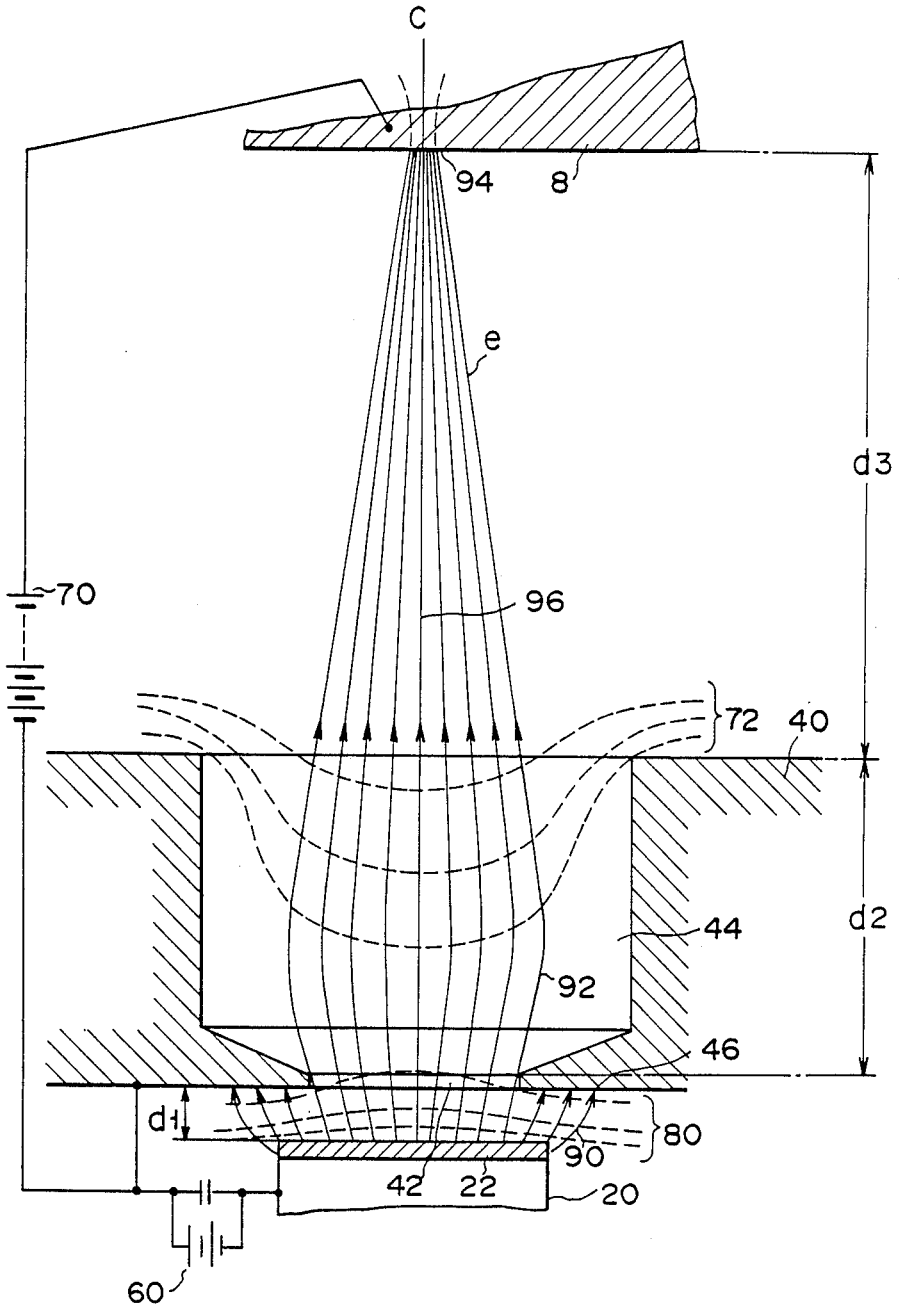
FIG. 6 is a view in which the loci of electron beams and the equipotential lines are shown in the section similar to that of FIG. 3 for explaining the operational mode in the X-ray tube apparatus according to a first embodiment of the invention.

The state of focussing of the electron beam according to this embodiment is illustrated in FIG. 6 in accordance with the results of simulation obtained with the use of an electronic computer. FIG. 6 is a sectional view corresponding to FIG. 3. When the cathode filament 20 is heated by being supplied, via the filament supporting strut 30, with the heating power from the power source 50 shown in FIG. 2, electrons are emitted from the surface of the filament 20. These electrons are accelerated by the electric field produced due to the action of the bias voltage applied across the electron beam limiting aperture 42 and the cathode filament 20. The electrons thus accelerated reach the electron beam limiting aperture 42.

Since the surface of the filament 20 and the opposing surface of the electron beam limiting aperture 42 are substantially in parallel to each other, the equipotential curves 80 in the zone between both surfaces are substantially parallel. Therefore, the loci of the electrons passing by the end portions of the electron beam limiting aperture 42 are not disturbed very much. Further, the electrons 90 emitted from the end portions and side faces of the filament 20 are absorbed into the inner walls 46 of the electron beam shaping electrode 40 and do not enter the focussing dimple 44.

Accordingly, of the electrons emitted from the central portion of the filament 20, only those having no fringing effect arrive at the anode target 8. The distance d1 between the electron beam limiting aperture 42 and the filament 20 is previously set so that the electrons emitted from the surface of the filament 20 may operate within a specified limited range of temperature by application of bias voltage. For this reason, the quantity of the electrons passing through the electron beam limiting aperture 42 is determined depending solely upon the temperature of the filament 20. The largeness of the electron density distribution on the anode target 8 can be varied with the bias voltage independently of the electric current value supplied thereto. The electrons 90 limited by the electron beam limiting aperture 42 heat the inner wall 46 thereof. However, the inner wall 46 gradually, radially increases in thickness outwards of the electron beam shaping electrode 40. The inner wall 46 has a high thermal conductivity, so that it is not locally overheated by the electrons 90 limited as mentioned above. When the electrons emitted from the filament pass by the distance of d1 through the zone defined between this filament 20 and the beam limiting aperture 42, they undergo the action as of a concave lens and are diffused in this zone. Despite this fact, the density of electrons in this gap is quite uniform. The electron beam having passed through the beam limiting aperture 42 is focussed with high intensity by the focussing dimple 44 which is sufficiently deep and which has the strong action of a convex lens. The beam waist of the electron beam is located, both in the widthwise direction and in the lengthwise direction of the focussing dimple 44, on the surface, or at a deeper portion, of the anode target 8.

The equipotential curves 72 inside the focussing dimple 44 exhibit no astigmation between the electron loci 96 at the center and the electron loci 92 at the end portion.

Although the foregoing description has referred to the operation on the short side, shown in FIG. 3, of the beam limiting aperture 42, a similar operation will be obtained on the long side, as well, shown in FIG. 2.

According to the first embodiment of the invention, the following excellent effects are obtained.

Firstly, since only the electrons emitted from the central portion of the cathode filament 20 are accelerated, it is possible to obtain a minute, sharp focal area which is substantially free of aberration. Further, since the electrons emitted from the side portions of the filament 20 are cut by the beam limiting aperture 42, any sub focal point is not formed.

That is, the actual focal area $e_o$ of electron beams on the target surface is sized such that the short side lx is about 50 μm and the long sidely is about 125 μm; and the apparent focal area Xo as viewed along the X-ray radiation axis X is substantially square in shape and is sized such that one side is about 50 μm, whereby a uniform distribution of electron density is obtained on the target surface.

Further, the actual focal area can have its shape varied substantially similarly and have its size varied while its one side is in the range of about 50 μm to about 1 mm, by varying the bias voltage from 50 V to 1000 V.

Secondly, the size of the X-ray apparent focal area can be varied while the shape thereof is kept substantially fixed, by controlling the bias voltage. Even when the anode current is increased, the shape of the actual focal area and the uniformity in the distribution of electron density are not degraded.

Figure 7:
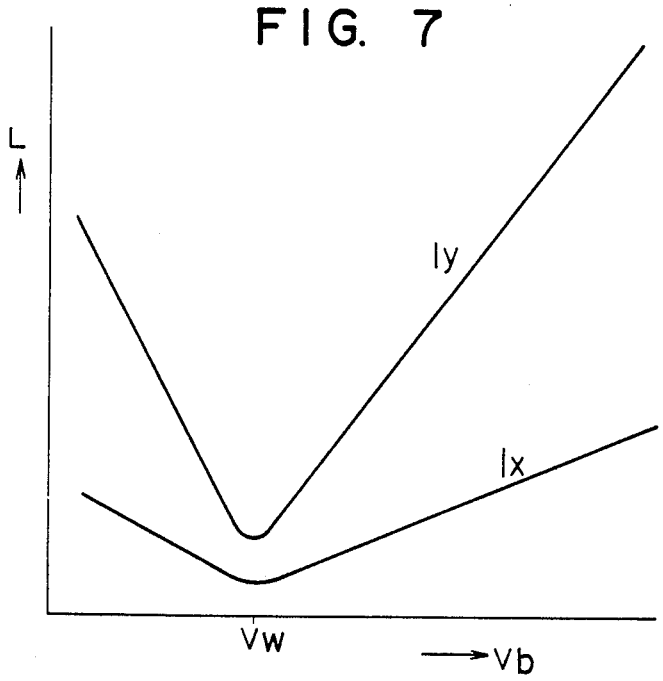
FIG. 7 is a graphical representation showing the relationship, as established in the X-ray tube apparatus according to the first embodiment of the invention, between the bias voltage and the lengths of the long side and short side of the sectional shape of the incident electron beam on the target surface.

When the invention is applied to an X-ray tube wherein the anode voltage is a maximum of 150 kV and the anode current used is a maximum of 800 mA, the value of the ratio between the long side and short side of the apparent focal area can be made about 1.4 or less by setting the dimensions of the respective portions of the rotating anode X-ray tube as mentioned above. The relationship between the bias potential Eb and the lengths L of the short side lx and long side ly of the actual focal area of the electron beam is shown in FIG. 7.

Figure 8:
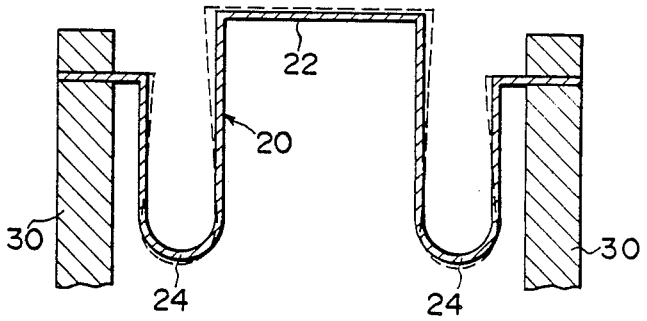
FIG. 8 is a schematic sectional view of a filament and filament-supporting struts, which is used to explain the structure of the filament shown in FIG. 2.

Thirdly, according to the invention, since the filament 20 is not deformed very much and the electron emission surface is uniform in temperature, the X-ray tube can operate stably. That is, as shown in FIG. 8, the thermal expansion of the filament 20 is almost entirely cancelled by the U-shaped portions thereof, so that the electron emission surface 22 is less displaced as indicated in FIG. 8 by a broken line. Further, since the expansion of the electron emission surface 22 is absorbed by the U-shaped portions 24 of the filament 20, the surface 22 is not curved. Further, since the mechanical strength of the U-shaped portion is sufficiently high and yet the weight thereof is small, the surface 22 does not vibrate very much due to external vibrations. In this way, it is possible at all times to keep the electron focussing characteristics good.

Figure 9:
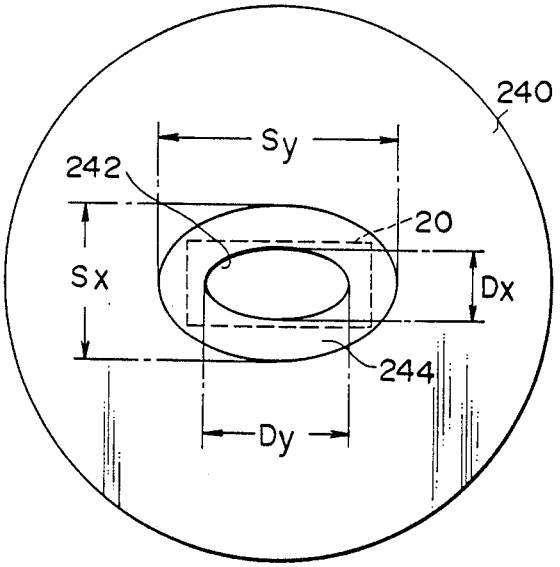
FIG. 9 shows a second embodiment of the present invention and is a plan view, similar to FIG. 4, of the beam shaping electrode, in which the electron emission portion of the filament is indicated by a broken line as in the case of FIG. 4.
Figure 10:
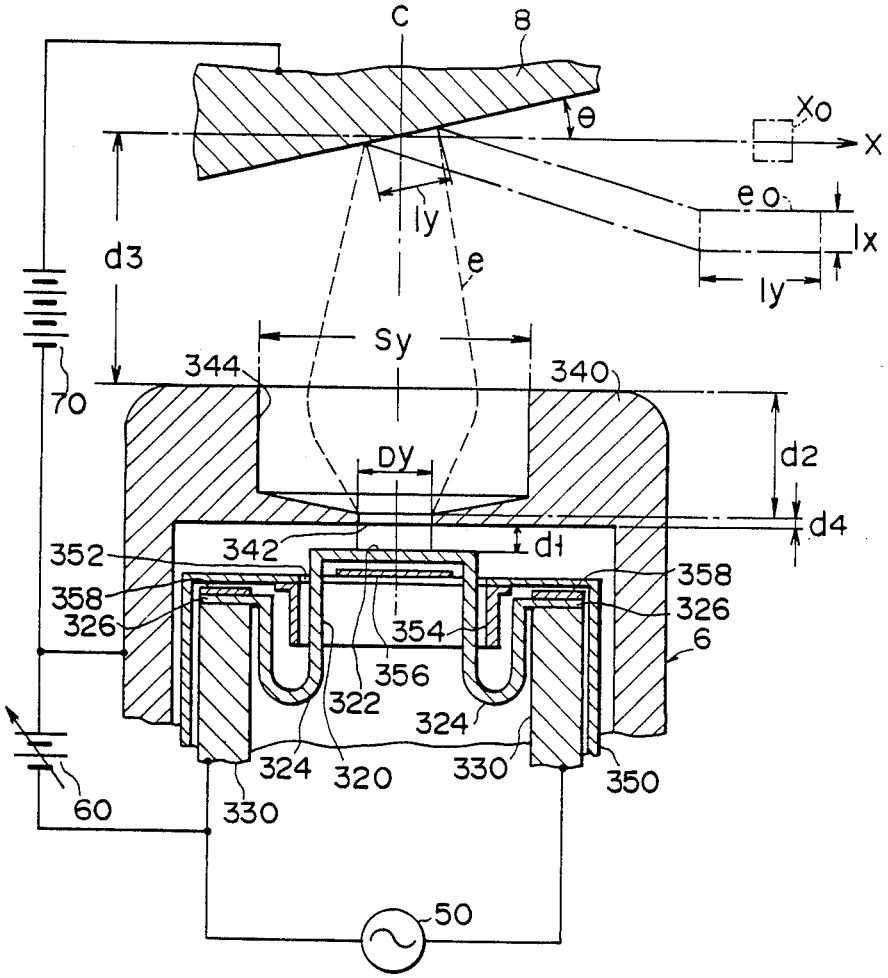
FIG. 10 shows a third embodiment of the present invention and is a sectional view, similar to FIG. 2, of the anode target and cathode assembly of the X-ray tube.
Figure 11:
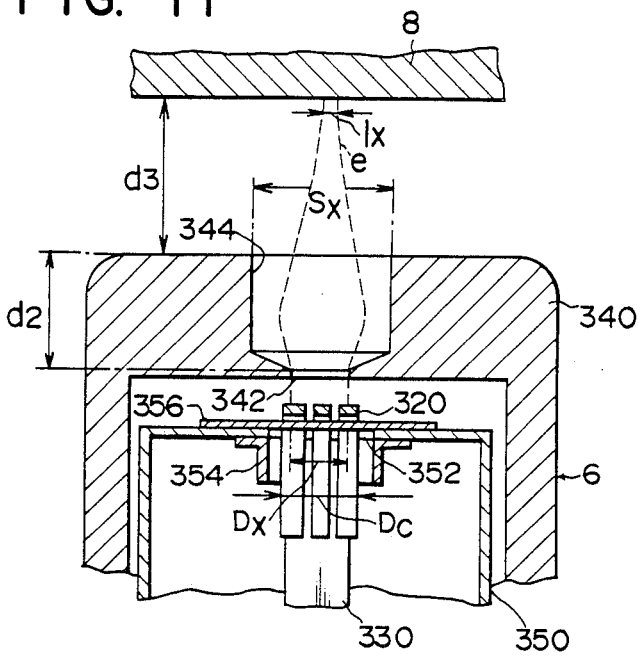
FIG. 11 is a sectional view, similar to FIG. 3, of the anode target and cathode assembly shown in FIG. 10.
Figure 12:
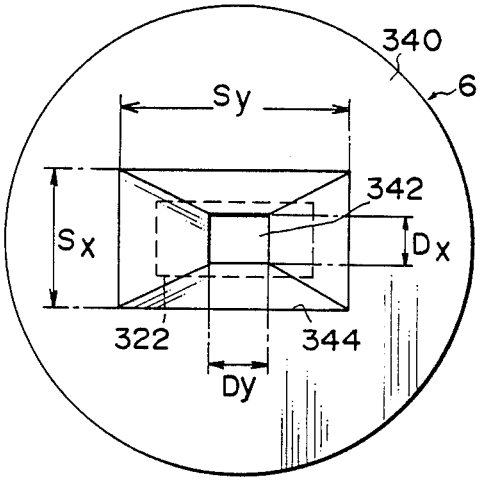
FIG. 12 is a plan view, similar to FIG. 4, of the beam shaping electrode shown in FIGS. 10 and 11, in which the electron emission portion of the filament is indicated by a broken line as in the case of FIGS. 4 and 9.
Figure 13:
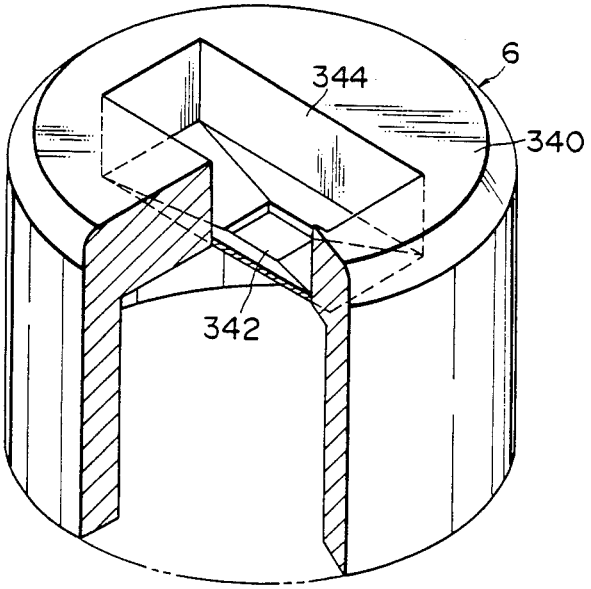
FIG. 13 is a perspective view, similar to FIG. 5, of the beam shaping electrode shown in FIG. 12.

An X-ray tube apparatus according to a second embodiment of the invention will now be described with reference to FIG. 9, while explaining the differences between the first and second embodiments.

In the preceding first embodiment, both the electron beam limiting aperture 42 and the focussing dimple 44 are formed rectangular in section. In this second embodiment shown in FIG. 9, however, both are made elliptical in section. The respective minor axes Dx, Sx and the respective major axes Dy, Sy of the beam limiting aperture 242 and the focussing dimple 244 are set to satisfy the requirement expressed in the above-mentioned formula (4). This makes it possible, in this second embodiment, to obtain the similar effects to those which are attainable in the first embodiment. In the elliptical, actual focal area of the electron beam on the anode target, the major axis is $1/\sin\theta$ of the minor axis. Accordingly, the apparent focal area Xo is in the form of a substantially true circle when it is viewed along the X-ray radiation axis X of the X-ray tube 2. Further, when the bias voltage is varied, the apparent focal area is varied in size while the circular configuration is always maintained as it is. Even when the setting conditions such as bias voltage are varied, the above-mentioned value of the ratio between the length of the major (the long) axis and the length of the minor axis of the actual focal area $e_o$ comes to range between $$\frac{1}{\sqrt{2}}\ \frac{1}{\sin\theta} \text{ and } \sqrt{2}\ \frac{1}{\sin\theta}.$$

Next, an X-ray tube apparatus according to a third embodiment of the invention will now be described with reference to FIGS. 10 to 18. In the embodiment, the same parts or sections as those which appear in the preceding first embodiment are denoted by like reference numerals.

In this third embodiment, the invention is applied to, for example, an X-ray tube wherein the anode voltage is 120 kV; the anode current is variable between 10 mA and 1000 mA; and the X-ray focal area is variable in size between 50 μm and 1 mm.

Figure 15:
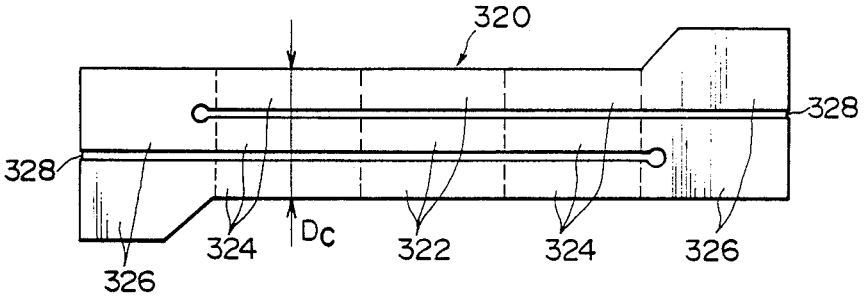
FIG. 15 is a plan view of a flat thin plate to be the filament shown in FIGS. 10 and 11 before it is assembled.
Figure 16:
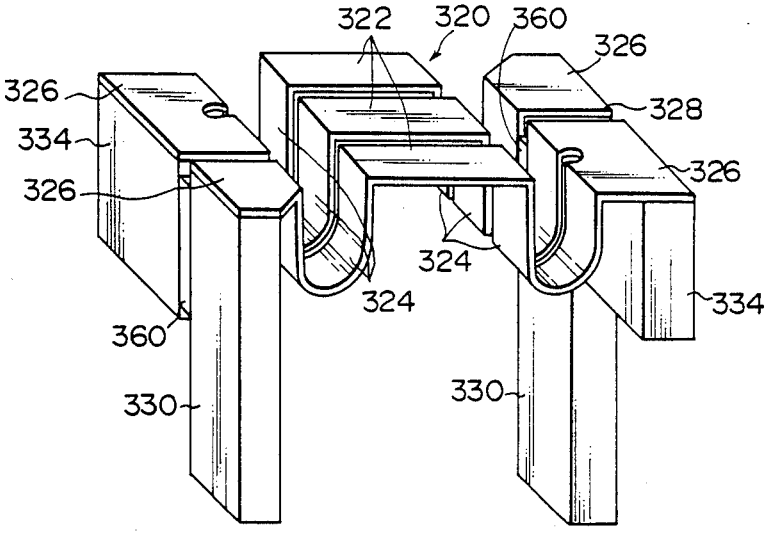
FIG. 16 is a perspective view of the filament shown in FIGS. 10 and 11.
Figure 17:
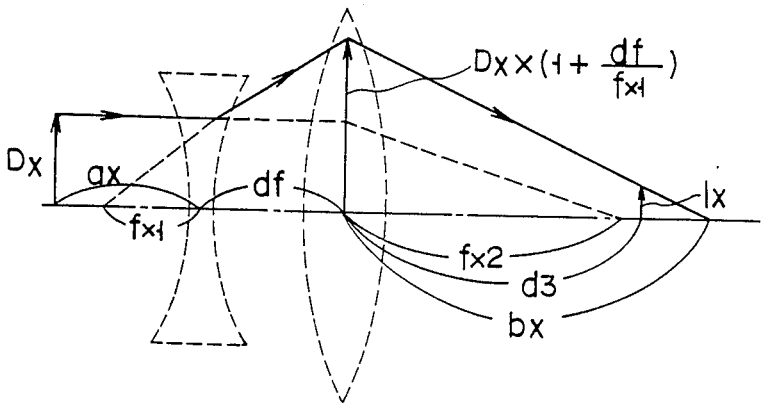
FIG. 17 is a view of the electron lens model showing a state wherein an electron beam is focussed in the widthwise direction of the focussing dimple provided in the X-ray tube according to the third embodiment of the invention.
Figure 18:
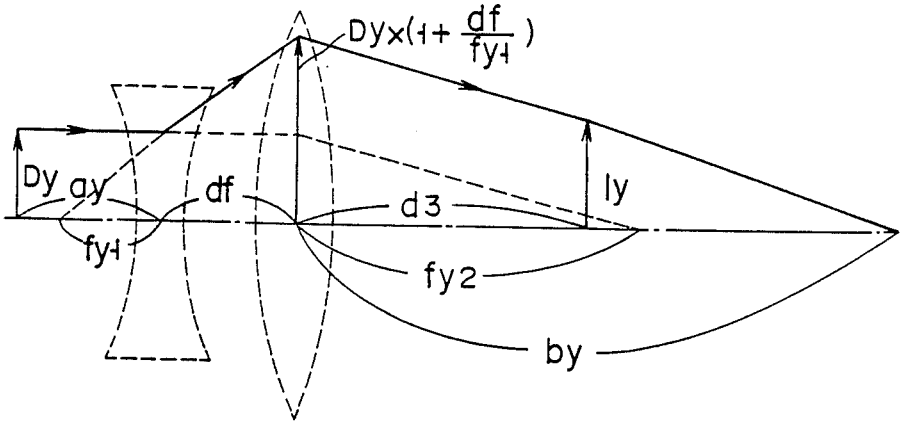
FIG. 18 is a view of the electron lens model, similar to FIG. 17, showing a state wherein an electron beam is focussed in the longitudinal direction of the focussing dimple.

In this third embodiment, the structure of the filament 320 differs from that which has been described in connection with the first and second embodiments. As shown in FIG. 15, this filament 320 has notched portions 328. As shown in FIG. 15, it consists of a thin plate which is formed of a heavy metal such as tungsten or tungsten alloy and which is, for example, approximately 0.03 mm in thickness and approximately 10 mm in width Dc. In FIG. 15, two notched portions 328, extending from one end portion to the other end portion, are provided. By bending the thin plate shown in FIG. 15, the filament 320, as shown in FIG. 16, is formed with a central flattened portion 322 and a pair of U-shaped portions 324 as in the case of the first embodiment. When electric current is passed through the filament 320 to heat the same, the central flattened portion 322 functions as an electron emission surface. Each fixing block 334 is mounted onto the filament supporting strut 330 via the insulating material. As shown in FIG. 16, the end portion 326 is attached, by, for example, laser welding, onto the filament supporting strut 330 and fixing block 334. Accordingly, when power is supplied to the filament to heat the same, the filament 320 is electrically connected in series between the filament supporting strut 330 by means of the notched portions 328.

In this embodiment, shielding members 350, 352 and 354 are mounted around the filament 320 in order to prevent the beam shaping electrode 340 from being overheated due to the action of the electron emitted from the portions of the filament 320 other than the electron emission surface 322. The members 350, 352 and 354 are kept at the potential equal or near to that of one filament supporting strut 330, and are insulated from the other filament supporting strut 330. It should be noted here that convenience will be offered if they are mechanically fixed to one of the filament supporting struts 330.

Figure 14:
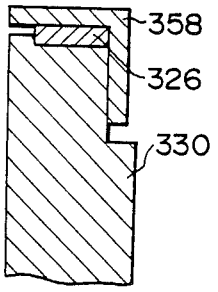
FIG. 14 is a sectional view showing the joining portion between the end portion of the filament and the filament-supporting strut shown in FIGS. 10 and 11.

As shown in FIG. 14, when the cathode filament 320 is sandwiched between the filament supporting strut 330 and a metal piece 356 consisting of, for example, molybdenum and the electron beam welding or laser beam welding are conducted from above the metal piece 356 to prepare a filament unit, both the filament 320 and the filament supporting struts 330 are joined together with a large area. In this case, as a result, the electric and thermal resistances are lowered to prevent a local overheating of the filament 320.

In this third embodiment, the focussing dimple 344 of the beam shaping electrode 340 is rectangular in shape. The beam limiting aperture 342 of the beam shaping electrode 340, however, is square in shape.

The conditional formulae (1) and (2) stated in the first embodiment are set as follows. That is, when lx, ly and $\theta$ are now assumed to represent the lengths of the short and long sides of the actual focal area $e_o$ on the target surface and the anode angle, respectively, the actual focal area $e_o$ is set to satisfy the following formula (5).

$$\frac{ly}{lx} = \frac{1}{\sin\theta} \tag{5}$$

Since the value of the ratio between the short and long sides of the apparent focal area as viewed along the X-ray radiation axis is permitted, as mentioned above, to have a value of approximately 1.4 as in the case of the formula (2), the value of the ratio between the short and long sides of the actual focal area may be in the following range.

$$\frac{1}{\sqrt{2}} \cdot \frac{1}{\sin\theta} \leqq \frac{ly}{lx} \leqq \sqrt{2} \cdot \frac{1}{\sin\theta} \tag{6}$$

When the minimal focal area (for example, when the length of one side is 50 μm) is obtained by a predetermined tube current, the position on which the dimension of the beam waist of the electron beam in the direction of the short side thereof, i.e., the dimension of the cross section of the electron beam e, is minimum is made to coincide with the target surface. Electron beam e gradually spreads out downstream of the beam waist due to mutual repulsion between electrons and thus the dimension of the cross section of the beam will increase. The longitudinal direction of the rectangular shape of the focal area of the beam is made to coincide with the X-ray radiation axis X.

When a positive voltage which is higher than the voltage of the cathode filament 320 is applied to electron beam limiting aperture 342 (as mentioned above) to obtain a larger focal area, the beam waist will be backwardly positioned at the anode target 8. The higher the bias voltage becomes, the further the beam waist moves backwards and the larger lx and ly become keeping the formula (6).

Consider now a case where the respective values of ly and lx are varied under the condition wherein a certain value k in the formula (6) is kept constant. At this time, $$ly = k \cdot lx \tag{7}$$

where k is a constant.

Reference will now be made to the input limit of the rotating anode X-ray tube. As is well known in the art, the power P (watt) capable of being inputted into the target rotating at the rotating frequency f per second can be expressed as follows.

$$P = \frac{\pi}{\sqrt{2}} \sqrt{\beta \cdot C \cdot \lambda \cdot R \cdot f} \times \Delta T \times ly \times lx^{\frac{1}{2}} \tag{8}$$

In this case, the beam waist on the target is of a rectangular shape wherein the long side is ly and the width as viewed in the rotating direction of the target is lx. ΔT represents the maximum temperature (degree) increase on the target surface from around the actual focal area, and $\beta$, C, and λ represent the density, specific heat and thermal conductivity of the target material. R represents the distance between the position at which electron beams are incident upon the target and the center of rotation thereof. When the formula (7) is substituted into the formula (8), $$P = K \cdot lx^{3/2} \tag{9}$$

where K is a constant which is contained in the formula (8).

Accordingly, when the size of the actual focal area which is nearly equal to the width lx is increased as mentioned above while satisfying the requirement in the formula (7), by increasing the bias voltage, the input power will increase as indicated in the formula (9). This indicates that where the tube voltage is fixed, the tube current can be increased. To this end, it is necessary to increase the cathode temperature and increase the emitting quantity of electrons by increasing, for example, the voltage level of the cathode heating power source. At this time, if the tube is so designed that the size of the focal area may increase by applying a decreased level of bias voltage, a diode comprised of the cathode and the electron beam limiting aperture is kept in the state of the space charge limit by the increase in the amount of the tube current and the decrease in the level of the bias voltage. Thus, the tube current cannot be increased even when the cathode temperature is increased.

However, according to this third embodiment, when the focal area is large, since a high bias voltage can be applied, the tube current can easily be increased by increasing the temperature of the cathode. Therefore, the tube can be used while the power is always kept at its input limit expressed in the formula (9). Thus, the invention is very effective in this regard.

Next, a description may now be given of the structures of the focussing dimple 344 which enable the actual focal area to be varied while maintaining formula (7).

Assume that fy1 and fx1 represent the respective focal lengths, in the lengthwise and widthwise directions, of a concave lens produced in the gap between the filament 320 and the electron beam limiting aperture 342, respectively, and that fy2 and fx2 represent the respective focal lengths, in the lengthwise and widthwise directions, of the focussing dimple 344, respectively. Also assume that Dy and Dx represent the lengths of the electron beam limiting aperture 342 as viewed in the lengthwise and widthwise directions, respectively, and that df represents the distance between the concave lens and a convex lens produced by the focussing dimple 344.

The value of the ratio ly/lx is obtained, and it is preferred that this value be fixed independently of the bias voltage applied across the filament 320 and the electron beam limiting aperture 342. The ratio ly/lx is differentiated by the bias voltage, and in order to make the differential value approximately equal to 0, only the following relations must be satisfied since fy1, fx1 < fx2, fy2 and fx2 ≈ d3.

$$\left.\begin{aligned} \frac{dfx1}{dVb} &= \frac{dfy1}{dVb} \\ fx1 &= fy1 \end{aligned}\right\} \tag{10}$$

In the above formula (10), Vb denotes a bias voltage.

A case where the formula (10) holds true is one where the distribution of intensity of the electric field due to the application of the bias voltage, as viewed in the lengthwise direction of the gap between the electron beam limiting aperture 342 and the cathode filament 320, is the same as that viewed in the widthwise direction thereof. Stated differently, such case is one where the relationship Dx = Dy holds true in the above-mentioned structure.

In this case, when Sy and Sx are assumed to represent the lengths of the focussing dimple 344 as viewed in the lengthwise and widthwise directions, respectively, the value of the ratio between Sy and Sx satisfying the requirement expressed in the formula (9) is experimentally determined by using a calculator, as follows.

$$1 < \frac{Sy}{Sx} \leqq \frac{2}{\sin\theta} \tag{11}$$

In this third embodiment as well, the depth d2 of the focussing dimple 344 is equal in both the lengthwise and widthwise directions so as to fabricate it easily, as in the preceding first and second embodiments. The focussing dimple 344 is constructed such that the depth d2 ranges from 0.25 to 1.0 with respect to the distance d3 between the top surface of the beam shaping electrode 340 and the position of the actual focal area on the target surface, as in the formula (3). However, the value of d3 may be greater if and insofar as the formula (11) holds true.

Since in this third embodiment only the electrons emitted from the central portion of the cathode filament 320 are accelerated as in the first embodiment, it is possible to obtain a focal area which is substantially free of aberration, whose edge is sharp and whose size is of any given dimension. Further, since the electron emitted from the sides of the filament 320 is limited by the electron beam limiting aperture 342, no sub focal area is formed.

The minimum size of the actual focal area $e_o$ of the electron beam on the target surface, i.e., the short side lx thereof is approximately 50 μm and the long side ly is approximately 180 μm, is obtained. On the other hand, when the target angle is 16°, the apparent focal area Xo as viewed along the X-ray radiation axis X is of a substantially square size wherein one side is approximately 50 μm. Thus, the distribution of electron density is uniform.

Further, by varying the bias voltage within the range of 50 V to 1000 V, it is possible to vary the size of the focal area from a size whose one side is approximately 50 μm to a size whose one side is approximately 1 mm while the shape thereof is kept substantially similar.

Further, in the third embodiment as well, it is possible to vary the size of the X-ray focal area as in the first embodiment while keeping the shape thereof substantially constant, by controlling only one factor of bias voltage. Besides, the shape of the focal area and the uniformity in the distribution of electron density is not degraded even when the anode current is increased.

When the invention is applied to an X-ray tube wherein the anode voltage is 150 kV at a maximum; and the anode current is used up to 1000 mA at a maximum in accordance with the size of the focal point by varying the voltage applied to the filament, it is possible to keep the value of the ratio between the long and short sides of the apparent focal area approximately 1.4 or less. The relationship between the bias potential and the short side lx and long side ly of the focal area is similar to that shown in FIG. 7. Thus, the value of the ratio between the long and short sides of the apparent focal area Xo can be kept to be approximately 1.4 or less.

Further, in the filament 320 of this third embodiment, the portions thereof divided by the notches are electrically connected in series between the filament supporting struts 330, so that the impedance of the filament 320 is increased. Thus, the filament can be made to operate with the current and voltage whose values are substantially the same as those which are used in the conventional X-ray tube. In addition, the deformation of the filament due to, for example, thermal expansion can also be lessened.

Figure 19:
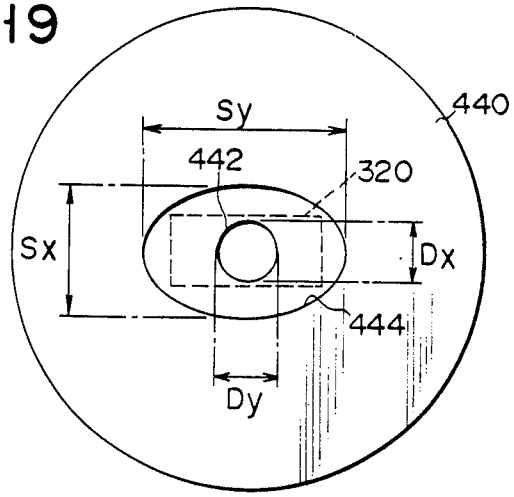
FIG. 19 shows a fourth embodiment of the invention and is a sectional view, similar to FIGS. 4, 9, and 12, of the beam shaping electrode.

In the above-mentioned embodiment, the electron beam limiting aperture 342 is formed into the square shape and the focussing dimple 344 is formed into the rectangular shape. As shown in FIG. 19, however, the electron beam limiting aperture 442 may be circular and the focussing dimple 444 elliptical. The focussing dimple 444 is constructed such that the length of minor axis Sx and the length of major length Sy satisfy the requirement expressed in the above-mentioned formula (4). By so doing, the same effect as that which is attainable in the preceding embodiments can be obtained. In this case, the focal area of the electron beam on the anode target assumes an elliptical shape whose length of its major axis has a length of $1/\sin\theta$ of the length of its minor axis. Accordingly, the apparent focal area Xo as viewed along the X-ray radiation axis of the X-ray tube is substantially in the form of a true circle. Further, when the bias voltage is varied, the size of the apparent focal area Xo is varied while the shape thereof is always kept substantially circular. The above-mentioned relationship still holds true even when the setting conditions such as bias voltage are varied.

In the above-mentioned embodiments, the widths of the end portion and/or the U-shaped portion of the filament 20 or 320 may be greater than the width of the electron emission surface 22 or 322.

Further, the electron beam limiting aperture 42, 242, 342 or 442 and the focussing dimple 44, 244, 344 or 444 are not always required to be made into an integral structure.

Further, even when the width of the electron emission surface 22, 322 of the cathode filament 20, 320 is smaller than the width of the electron beam limiting aperture 42, 242, 342 or 442, the X-ray tube can have the same effects as mentioned above.

Further, even when the electric current applied to the X-ray tube is varied, a desired size of apparent focal area can be obtained, in spite of such variation of the tube current, by varying the bias voltage correspondingly.

Figure 20:
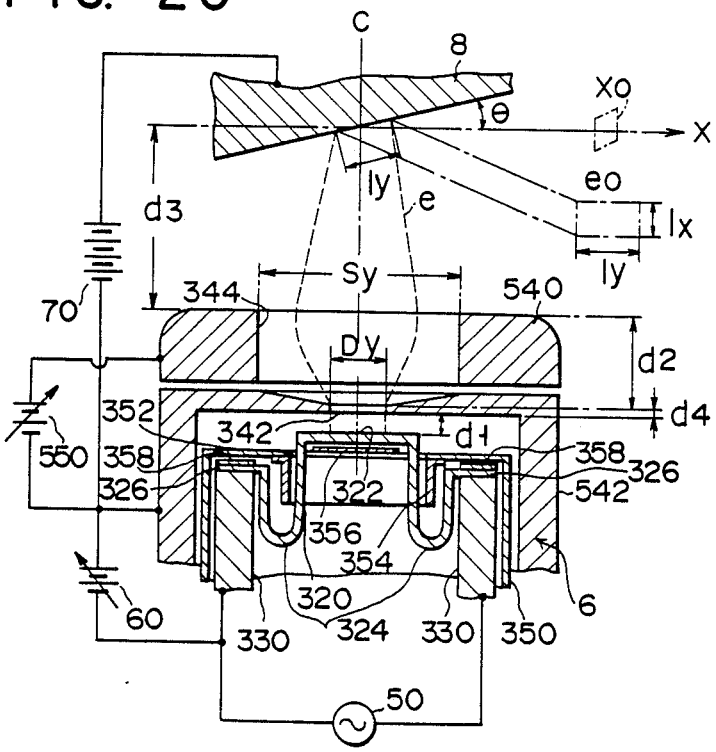
FIGS. 20 and 21 show a fifth embodiment of the invention and are sectional views similar to FIGS. 2 and 3, and FIGS. 10 and 11, respectively.
Figure 21:
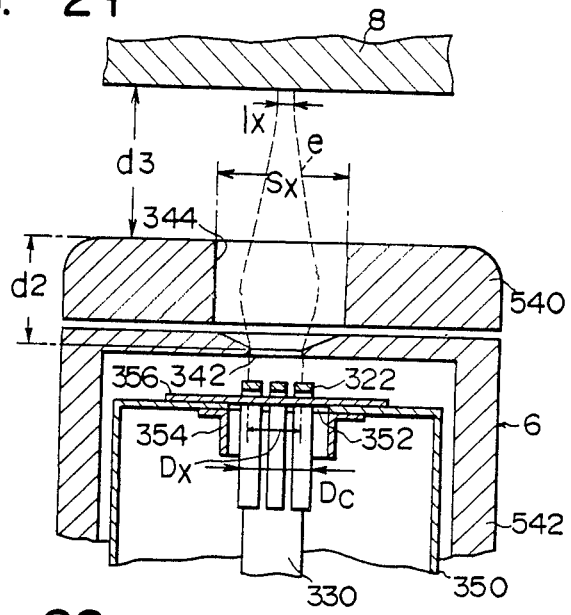

Further, in above embodiments, the electron beam limiting aperture 42, 242 and the focussing dimple 44, 244, 344 or 444 are provided in the integrally structured electron beam shaping electrode 40, 240, 340 or 440. However, both may of course be provided therein in a manner that they are separate from each other, whereby another bias voltage may of course be applied thereacross. This embodiment is illustrated in FIGS. 20 and 21. In FIGS. 20 and 21, the electron beam limiting aperture 342 and focussing dimple 344, similar to those which are shown in the preceding third embodiment, are formed in separate electrodes 542 and 540, respectively. Further, a variable voltage 550 is provided between these electrodes 542 and 540.

Further, a heater type cathode such as, for example, a barium impregnated cathode can of course be used as the cathode of the X-ray tube.

Further, even when the electron emission surface of the filament 20, 220, 320 or 420 is curved, it is possible to produce the same effects as in the preceding embodiments.

An X-ray tube apparatus according to the invention may be applied to an X-ray photographing apparatus including an X-ray detector.

Figure 22:
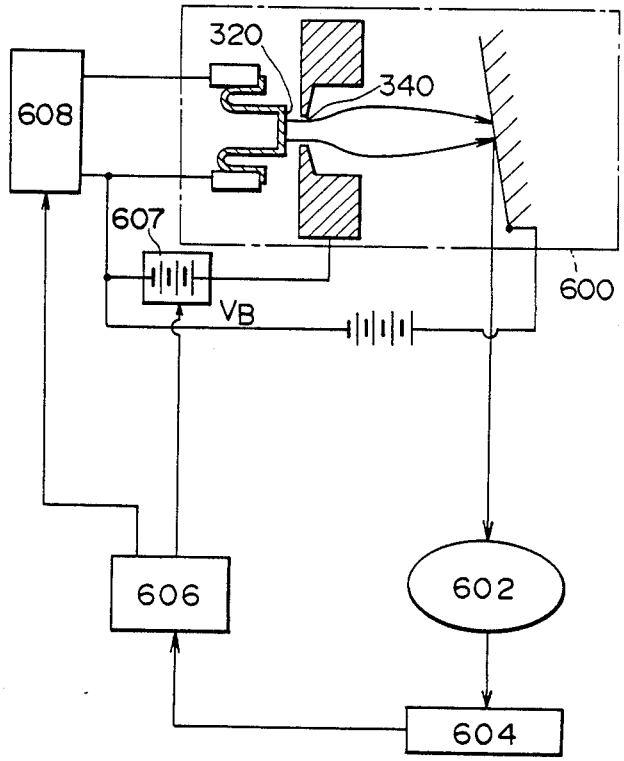
FIG. 22 is a block diagram of an X-ray photographing apparatus using the X-ray tube apparatus according to the invention.

As in the X-ray photographing apparatus shown in FIG. 22, the output of an X-ray detector 604 in conformity with the size and quality of a foreground subject 602 can be inputted into a comparator 606, and the bias voltage Vb of the bias power source 607 and the voltage of the cathode heating power source 608 can automatically be determined from a relationship set beforehand, so as to obtain the necessary output of X-rays. Thus, whatever size and quality a foreground subject may have, it is possible to automatically set the X-ray tube to a optimum condition therefor.

With the above construction of the photographing apparatus, when the required amount of tube current is set in the range within which the anode target is not fused, the voltage applied to each portion of the X-ray tube is automatically determined in such a manner as to form a focal area having the smallest possible size. Therefore, the optical resolution and contrast of the screen can be obtained irrespectively of the properties of the subject.

What is claimed is:

1. An X-ray tube apparatus comprising:

an X-ray tube including a vacuum envelope having a tube axis, an anode target and a cathode assembly means which are disposed within said vacuum envelope in a manner to oppose each other, said cathode assembly means including:

a flat plate-like filament for generating an electron beam;

beam shaping electrode means formed with a rectangular beam limiting aperture and with a focusing dimple having a shape substantially similar to said beam limiting aperture, said beam shaping electrode means being insulated from said filament, when Sy, Sx, Dy, Dn are assumed to represent the longitudinal length of said focusing dimple, the lateral length of said focusing dimple, the longitudinal length of said beam limiting aperture, and the lateral length of said beam limiting aperture, respectively, and P and Q are assumed to represent the value of the ratio Sy/Dy and the ratio Sx/Dx, respectively, the value of the ratio (P/Q) of P to Q satisfies the inequality:

$$0.4 < P/Q < 2.0;$$

a concave electrostatic lens for diverging the electron beam from said filament to the beam shaping electrode means, which is formed between said beam shaping electrode means and said filament; and, a convex electrostatic lens for converging the diverged electron beam passing through the beam limiting electrode means to a focal point defined by the concave and convex electrostatic lenses, which is formed within the dimple of said beam shaping electrode;

said anode target having a target surface which is disposed between the beam shaping electrode means and the focal point of the lenses and on which the converged electron beam is impinged to form an electron beam spot which has longitudinal length ly and lateral length lx, X-rays being irradiated from the electron beam spot in an X-ray irradiation direction, when d2 and d3 are assumed to represent a depth of said focusing dimple and a distance between said beam shaping electrode and said target surface, respectively, the value of the ratio of d2 and d3 satisfies the equality or inequality:

$$1.0 \leqq d3/d2 \leqq 4.0,$$

when $\theta$ is assumed to represent an anode angle defined between the target surface of said anode target and the X-ray irradiation direction, the relationship between said anode angle $\theta$ and the value of the ratio Sy/Sx of said longitudinal length Sy to the lateral length Sx satisfies the inequality:

$$1 < Sy/Sx < 2/\sin\theta$$

and power source means including a first power source for applying first voltage across said anode target and said filament, a second power source for applying an electric current to said filament so as to heat the same, and a third power source for applying a bias voltage to said beam shaping electrode means, said bias voltage being positive against said filament and the focal point being shifted away from said target as the bias voltage is increased, whereby the size of the beam spot is increased in such a manner that the ratio of ly/lx is maintained within the range of 1.4.

2. An X-ray tube apparatus according to claim 1, said X-ray tube further including a pair of filament supporting struts for supporting said flat-plate like filament, and said flat-plate like filament has a flat central portion so positioned as to oppose said beam limiting aperture, a pair of U-shaped portions which are extended from both ends of said central portion in the direction away from said anode target and bent back toward said anode target, and a pair of supported end portions each extending from each said U-shaped portion, said supported end portions being mounted on said filament supporting struts, respectively.

3. An X-ray tube apparatus according to claim 2, said filament having at least two notched portions extending in opposite directions from the respective supported end portions and forming a series current path of the filament between the opposite supported end portions thereof.

4. An X-ray tube apparatus accoring to claim 1, said beam limiting aperture having a square configuration while said focussing dimple is either rectangular or elliptical; and the longitudinal axis of said focussing dimple is located in a flat plane including respective center axes of said electron beam and said X-rays.

5. An X-ray tube apparatus according to claim 1, the first voltage of said first power source being variable, so that when said bias voltage is made high the filament current increases, such that the quantity of said electron beam is increased.

6. An X-ray tube apparatus according to claim 1, said beam shaping electrode means including first and second members which are separated and insulated from each other, said beam limiting aperture being formed in said first member and said focussing dimple being formed in said second member.

7. An X-ray tube apparatus comprising:

an X-ray tube including a vacuum envelope having a tube axis, an anode target and a cathode assembly means which are disposed within said vacuum envelope in a manner to oppose each other, said cathode assembly means including:

a flat plate-like filament for generating an electron beam;

beam shaping electrode means formed with an elliptical beam limiting aperture and with a focusing dimple having a shape substantially similar to said beam limiting aperture, said beam shaping electrode means being insulated from said filament, when Sy, Sx, Dy, Dn are assumed to represent the longitudinal length of said focusing dimple, the lateral length of said focusing dimple, the longitudinal length of said beam limiting aperture, and the lateral length of said beam limiting aperture, respectively, and P and Q are assumed to represent the value of the ratio Sy/Dy and the ratio Sx,Dx, respectivley, the value of the ratio (P/Q) of P to Q satisfies the inequality:

$$0.4 < P/Q < 2.0;$$

a concave elecltrostatic lens for diverging the electron beam from said filament to the beam shaping electrode means, which is formed between said beam shaping electrode means and said filament; and, a convex electrostatic lens for convertging the diverged electron beam passing through the beam limiting electrode means to a focal point defined by the concave and convex electrostatic lenses, which is formed within the dimple of said beam shaping electrode;

said anode target having a target surface which is disposed between the beam shaping electrode means and the focal point of the lenses and on which the converged electron beam is impinged to form an electron beam spot which has longitudinal length ly and lateral length lx, X-rays being irradiated from the electron beam spot in an X-ray irradiation direction, when d2 and d3 are assumed to represennt a depth of said focusing dimple and a distance between said beam shaping electrode and said target surface, respectively, the value of the ratio of d2 to d3 satisfies the equality or inequality:

$$1.0 \leqq d3/d2 \leqq 4.0,$$

when $\theta$ is assumed to represent an anode angle defined between the target surface of said anode target and the X-ray irradiation direction, the relationship between said anode angle $\theta$ and the value of the ratio Sy/Sx of said longitudinal length Sy to the lateral length Sx satisfies the inequality:

$$1 < Sy/Sx < 2/\sin\theta$$

and power soure means including a first power source for applying first voltage across said anode traget and said filament, a second power source for supplying an electric current to said filament so as to heat the same, and a third power source for applying a bias voltage to said beam shaping electrode means, said bias voltage being positive against said filament and the focal point being shifted away from said target as the bias voltage is increased, whereby the size of the beam spot is increased in such a manner that the ratio of ly/lx is maintained within the range of 1.4.

8. An X-ray tube apparatus according to claim 7, said X-ray tube further including a pair of filament supporting struts for supporting said flat-plate like filament, and said flat-plate like filament has a flat central portion so positioned as to oppose said beam limiting aperture, a pair of U-shaped portions which are extended from both ends of said central portion in the direction away from said anode target and bent back toward said anode target, and a pair of supported end portions each extending from each said U-shaped portion, said supported end portions being mounted on said filament supporting struts, respectively.

9. An X-ray tube apparatus according to claim 8, said filament having at least two notched portions extending in opposite directions from the respective supported end portions and forming a series current path of the filament between the opposite supported end portions thereof.

10. An X-ray tube apparatus according to claim 7, said beam limiting aperture being in the form of a substantially true circle while said focussing dimple is either rectangular or elliptical, and the longitudinal axis of said focussing dimple is located in a flat plane including respective center axes of said electron beams and said X-rays.

11. An X-ray tube apparatus according to claim 7, the first voltage of said first power source being variable, so that when said bias voltage is made high the filament current increases, such that the quantity of said electron beam is increased.

12. An X-ray tube apparatus according to claim 7, said beam shaping electrode means including first and second members which are separated and insulated from each other, said beam limiting aperture being formed in said first member and said focussing dimple being formed in said second member.

* * * * *